United States Patent [19]

O'Gara

[11] Patent Number: 4,782,677

[45] Date of Patent: Nov. 8, 1988

[54] LOCK REPAIR PLATE FOR SURFACE MOUNTED BOLT CASINGS

[76] Inventor: James O'Gara, 444 W. 258th St., Riverdale, N.Y. 10471

[21] Appl. No.: 34,752

[22] Filed: Apr. 6, 1987

[51] Int. Cl.[4] ..... E05B 9/08

[52] U.S. Cl. ..... 70/417; 70/451; 70/452; 70/462

[58] Field of Search ..... 70/452, 417, 131, 438, 70/462, 451; 411/177, 178, 179, 180

[56] References Cited

U.S. PATENT DOCUMENTS

| | | | |
|---|---|---|---|
| 1,579,126 | 3/1926 | Maxwell | 70/417 |
| 4,522,048 | 6/1985 | Davis | 70/417 |
| 4,688,409 | 8/1987 | Oliver | 70/452 |
| 4,690,599 | 9/1987 | Shinjo | 411/180 |

*Primary Examiner*—Robert L. Wolfe
*Attorney, Agent, or Firm*—Herbert Dubno

[57] ABSTRACT

The lock repair plate has threaded holes at the same locations as the holes in a standard mounting plate, the threaded holes being in registration with the holes in the bolt casing, which are traversed by machine screws for mounting the casing on the repair plate. The repair plate is further provided with a plurality of screw holes offset from the threaded holes and which are traversed by plate screws for mounting the repair plate on a door, the plate also being formed with an opening through which the tongue of the lock cylinder can extend, the opening being flanked by first and second pairs of apertures formed in the plate and being selectively in registration with the standard threaded bores of the cylinder which flank the tongue, one of the pair of apertures being traversed selectively by a pair of cylinder screws for securing the cylinder to the plate. A bump is formed on the outwardly facing surface of the plate as an indicator for insuring that the outwardly facing surface is not mounted facing the door.

21 Claims, 2 Drawing Sheets

LOCK REPAIR PLATE FOR SURFACE MOUNTED BOLT CASINGS

FIELD OF THE INVENTION

The present invention relates, in general, to door locks, and, more particularly, to door locks having surface mounted bolt casings.

BACKGROUND OF THE INVENTION

Normally, door locks of this type have a lock cylinder disposed in the door and braced against the outer side of the door, while on the inner side of the door, a mounting plate is provided and secured to the cylinder, so that both the plate and the cylinder mutually support one another.

The plate is provided with a plurality of holes in registration with respective holes in the bolt casing, and which are traversed by casing screws which also traverse the plate holes and serve to mount the casing directly to the door.

In a forced entry situation, the casing screws securing the bolt casing to the door are torn out of the screw holes in the door and in the process, these screw holes are destroyed and cannot be used again for holding a screw, so that the entire lock assembly must be relocated to another part of the door, and the destroyed portion of the door must be repaired, as well as the bore in which the cylinder was disposed.

OBJECTS OF THE INVENTION

It is therefore an object of the present invention to provide an improved repair system to obviate the aforementioned drawbacks.

It is another object of the present invention to provide a lock repair plate for surface mounted bolt casings which will enable a bolt casing to be remounted at the same location on a door after sustaining a forced entry.

SUMMARY OF THE INVENTION

The above and other objects are attained in a lock repair plate which has threaded holes at the same locations as the holes in a standard mounting plate, the threaded holes being in registration with the holes in the bolt casing. The repair plate is further provided with a plurality of screw holes offset from the threaded holes, as well as an opening through which the tongue of the lock cylinder can pass, the opening being flanked by first and second pairs of apertures formed in the plate and being selectively in registration with the standard threaded bores of the cylinder which flank the tongue. A bump is formed on the outwardly facing surface of the plate, as an indicator for insuring that the outwardly facing surface is not mounted facing the door, for reasons which will become more apparent hereinafter.

In use, the repair plate is mounted at the appropriate edge of the door, with the first or second pair of apertures in registration with the threaded bores of the cylinder, by plate screws traversing the screw holes. Cylinder screws traverse the apertures in registration with the threaded bores and engage in same, securing the cylinder to the repair plate.

Each of the threaded holes is formed in a respective insert provided in the plate and formed with a flange seated in a recess and abutting a rearwardly facing shoulder formed in the plate for preventing the insert from being pulled out of the plate from the outwardly facing surface thereof, the holes in the casing being traversed by machine screws engaging the threaded holes, enabling mounting of the bolt casing on the repair plate, rather than directly on the door, thereby negating any damage to the screw holes in the door.

BRIEF DESCRIPTION OF THE DRAWINGS

The above and other objects, features and advantages of the invention will become more readily apparent from the following description, reference being made to the accompanying drawing, in which.

SPECIFIC DESCRIPTION

Figure 1:
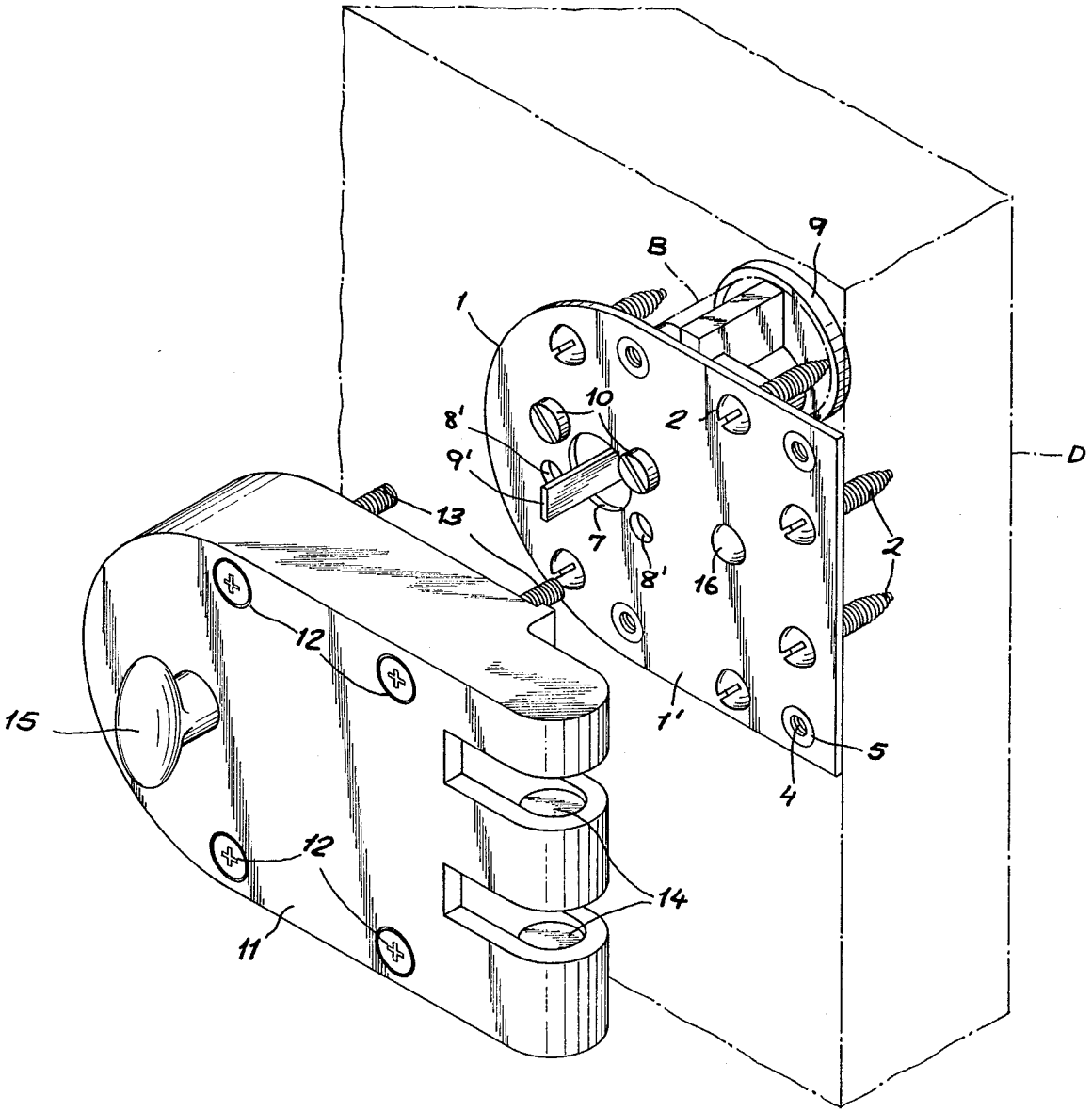
FIG. 1 is an exploded perspective view of a lock assembly having a repair plate according to the invention mounted at the right hand edge of a door.
Figure 5:
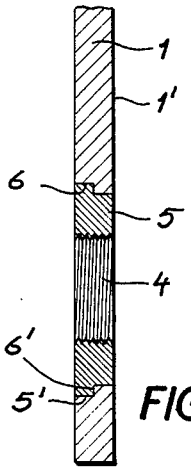
FIG. 5 is a sectional view drawn to an enlarged scale taken along line V—V of FIG. 3.

FIG. 1 illustrates the entire lock system, in which the lock repair plate 1 is shown mounted at the right hand edge of a door D, represented in dot-dash lines in the drawing, by plate screws 2 traversing screw holes 3 formed in the plate. The plate 1 is further provided with threaded holes 4 offset from the screws holes 3 and formed in inserts 5, at the same locations as the screw holes in a standard mounting plate, each insert 5 being formed with a flange 5' seated in a recess 6 and abutting a rearwardly facing shoulder 6' formed in the plate 1 and lying flush with the front and rear surfaces thereof, as illustrated in FIG. 5. The plate 1 is also formed with an opening 7 flanked by a first pair of apertures 8 and a second pair of apertures 8'.

A lock cylinder 9 is disposed in a bore B formed in the door D and has a tongue 9' which extends through the opening 7 and a pair of standard threaded cylinder bores lying in registration with either pair of apertures 8 or 8', depending on which edge of the door the plate is mounted at, the appropriate pair of aperture being traversed by cylinder screws 10 engaging the threaded bores for securing the cylinder 9 to the plate 1.

A bolt casing 11 is formed with holes 12 lying in registration with the threaded holes 4 and are traversed by machine screws 13 having threads matching those of the holes 4 and are engaged in same for mounting the casing 11 on the plate 1. The casing 11 also houses a vertically displaceable bolt 14 connected to a lock mechanism which is engaged by the tongue 9' of the lock cylinder 9 and by a knob 15 for operating the bolt 14 from the inner side of the door without a key. In another embodiment of the invention not illustrated, the bolt is horizontally displaceable.

Although the repair plate 1 can be used initially as a mounting plate, it is meant as a substitute for a mounting plate in cases where the lock assembly has sustained forced entry, in which the mounting screws are ripped out of the door leaving screw holes which are stripped and cannot hold a screw. To overcome this, the plate 1 is formed with the threaded holes 4 overlying and in registration with the destroyed screw holes and the screw holes 3 by which the plate 1 is mounted are offset from the destroyed holes so that the plate screws 2 can engage an undamaged part of the door, while the flanges 5' act to prevent the inserts 5 from being pulled out of the plate 1 from the outwardly facing surface 1' thereof.

Figure 3:
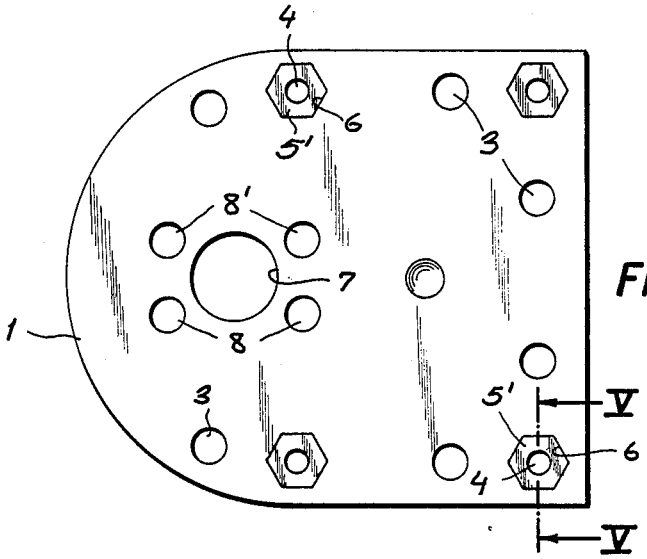
FIG. 3 is a rear elevational view of the repair plate shown in FIG. 2.

As shown in FIG. 3, the flanges 5' have a hexagonal outline which matches the outline of recess 6 for preventing rotation of the insert 5.

Normally with a standard mounting plate, only one pair of apertures is provided for mounting the cylinder, so that as the plate is used at different edges of the door it is simply flipped over to maintain the apertures in registration with the threaded bores of the cylinder. In the present case however, since the surface 1' of the plate 1 must be maintained facing outwardly so that the flanges 5' can act to prevent removal of the inserts, the plate 1 is simply turned upside down and provided with the two pairs of apertures 8 and 8', so that one pair will always be in registration with the threaded bores of the cylinder. To this end, the plate 1 is further formed with a bump 16 on the surface 1' as an indicator to insure that this surface is never mounted facing the door.

Figure 2:
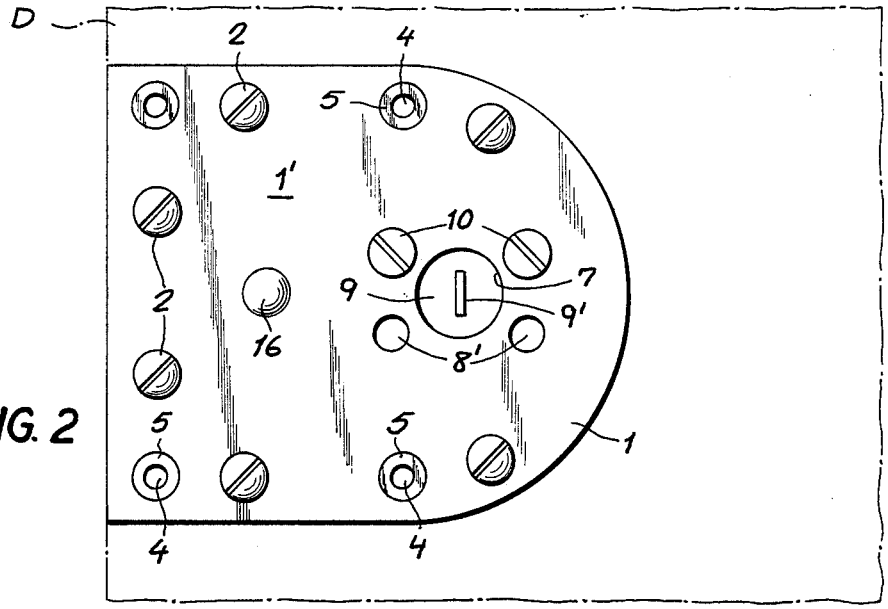
FIG. 2 is a front elevational view of the repair plate mounted at the left hand edge of a door.
Figure 4:
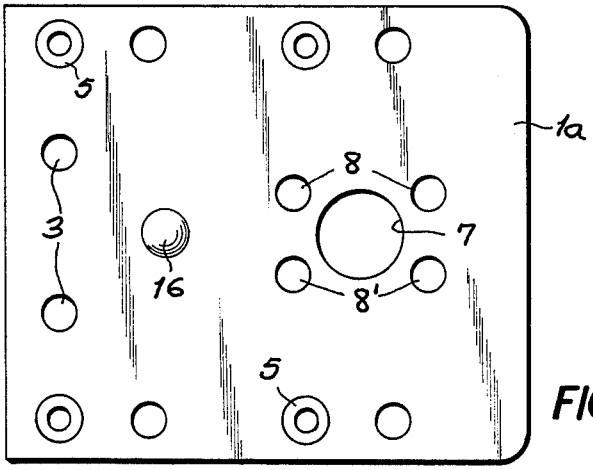
FIG. 4 is a front elevational view of another embodiment of the invention.

In FIGS. 1–3 there has been illustrated a bolt casing 11 with a semi-circular outline at one end thereof, such as a Segal-type lock, and the complementary shaped plate 1. FIG. 4 illustrates a repair plate 1*a* which has a rectangular outline and is provided for bolt casings also having a rectangular outline, all of the other elements of plate 1*a* being identical to those of plate 1.

I claim:

1. A lock repair plate assembly for a surface mounted bolt casing, said assembly comprising:

a plate having an opening through which an operating tang can connect a lock cylinder with said casing;

a plurality of threaded holes provided in said plate at locations for registration with respective holes formed in said bolt casing and normally used for securing said casing directly to a door;

respective casing screws having matching threads with those of said threaded holes passing through said respective holes of said casing and engaging said threaded holes of said plate for mounting said casing on said plate;

a plurality of screw holes formed in said plate and offset from said threaded holes for enabling said plate to be mounted on said door by respective plate screws traversing said screw holes in a first position of said plate at one edge of said door;

a first pair of apertures formed in said plate flanking said opening for registration with threaded bores of said cylinder in said first position of said plate;

a second pair of apertures formed in said plate flanking said opening for registration with said threaded bores of said cylinder in a second position of said plate at another edge of said door;

a pair of cylinder screws traversing selectively one of said pairs of apertures for engagement with said threaded bores for securing said cylinder to said plate, each of said threaded holes being formed in a respective insert provided in said plate, said insert being formed with a flange seated in a recess and abutting a rearwardly facing shoulder formed in said plate for preventing said insert from being pulled out of said plate from an outwardly facing surface thereof, said inserts being flush with said outwardly facing surface and with an inwardly facing surface of said plate; and indicator means on an outwardly facing surface of said plate opposite said door for insuring that said outwardly facing surface is not mounted facing said door.

2. The assembly defined in claim 1 wherein each of said threaded holes being formed in a respective insert provided in said plate, said insert being formed With a flange seated in a recess and abutting a rearwardly facing shoulder formed in said plate for preventing said insert from being pulled out of said plate from an outwardly facing surface thereof.

3. The assembly defined in claim 1 wherein said flange and said recess have matching prismatic outlines for preventing rotation of said insert in said plate.

4. The assembly defined in claim 1 wherein said plate has an outline complementary to an outline of said casing.

5. The assembly defined in claim 3 wherein said inserts are flush with said outwardly facing surface and with an inwardly facing surface of said plate.

6. The assembly defined in claim 4 wherein one side of said plate has a semi-circular outline.

7. The assembly defined in claim 4 wherein said plate has a rectangular outline.

8. The assembly defined in claim 1 wherein said indicator means is an outwardly projecting bump.

9. A lock assembly for a door comprising:

a plate formed with a plurality of screw holes traversed by respective plate screws for mounting said plate on said door;

indicator means on an outwardly facing surface of said plate opposite said door for insuring that said outwardly facing surface is not mounted facing said door;

an opening formed in said plate;

a lock cylinder disposed in said door and provided with a tongue extending through said opening in said plate, and a pair of threaded bores formed in said cylinder flanking said tongue;

first and second pairs of apertures formed in said plate flanking said opening and being selectively in registration with said threaded bores in respective first and second positions of said plate on said door, one of said pairs of apertures being selectively traversed by a pair of cylinder screws for engagement in said threaded bores for securing said cylinder to said plate;

a plurality of threaded holes provided in said plate offset from said screw holes;

a casing formed with a plurality of holes arranged at locations for registration with said threaded holes and normally used for securing said casing directly to said door, respective machine screws having matching threads with those of said threaded holes traversing said respective holes of said casing and engaging said threaded holes of said plate for mounting said casing on said plate; and a displaceable bolt disposed in said casing and operatively connected with said tongue of said lock cylinder, each of said threaded holes provided in said plate is formed in a respective insert provided in said plate, said insert being formed with a flange seated in a recess and abutting a rearwardly facing shoulder formed in said plate for insuring that said insert cannot be pulled out of said plate from the outwardly facing surface thereof, said inserts being flushed with said outwardly facing surface and with an inwardly facing surface of said plate.

10. The lock assembly defined in claim 9 wherein said flange and said recess have matching prismatic outlines for preventing rotation of said insert in said plate.

11. The lock assembly defined in claim 9 wherein said plate has an outline complementary to an outline of said casing.

12. The lock assembly defined in claim 11 wherein said plate has a semi-circular outline at one end thereof.

13. The lock assembly defined in claim 13 wherein said plate has a rectangular outline.

14. The lock assembly defined in claim 9 wherein said indicator means is an outwardly projecting bump.

15. The lock assembly defined in claim 9 wherein said cylinder lock is operatively connected with said bolt by a lock mechanism disposed in said casing and connected to said bolt and engaged by said tongue of said lock cylinder.

16. The lock assembly defined in claim 9 wherein said bolt is vertically displaceable.

17. The lock assembly defined in claim 9 wherein said bolt is horizontally displaceable.

18. A lock assembly for a door comprising:

a plate formed with a plurality of screw holes traversed by respective plate screws for mounting said plate on said door;

indicator means in the form of an outwardly projecting bump on an outwardly facing surface of said plate opposite said door for insuring that said outwardly facing surface is not mounted facing said door;

an opening formed in said plate;

a lock cylinder disposed in said door and provided with a tongue extending through said opening in said plate, and a pair of threaded bores formed in said cylinder flanking said tongue;

first and second pairs of apertures formed in said plate flanking said opening and being selectively in registration with said threaded bores in respective first and second positions of said plate on said door, one of said pairs of apertures being selectively traversed by a pair of cylinder screws for engagement in said threaded bores for securing said cylinder to said plate;

a plurality of threaded holes provided in said plate offset from said screw holes;

a casing formed with a plurality of holes arranged at locations for registration with said threaded holes and normally used for securing said casing directly to said door, respective machine screws having matching threads with those of said threaded holes traversing said respective holes of said casing and engaging said threaded holes of said plate for mounting said casing on said plate; and a displaceable bolt disposed in said casing and operatively connected with said tongue of said lock cylinder.

19. The lock assembly defined in claim 18 wherein said flange and said recess have matching prismatic outlines for preventing rotation of said inserts in said plate.

20. The lock assembly defined in claim 18 wherein said plate has an outline complementary to an outline of said casing.

21. The lock assembly defined in claim 20 wherein said plate has a semi-circular outline at one end thereof.

* * * * *